US010781064B2

(12) United States Patent
Horiuchi

(10) Patent No.: US 10,781,064 B2
(45) Date of Patent: Sep. 22, 2020

(54) METHOD FOR APPLYING AIR TO SHEETS STACKED ON SHEET STACKING APPARATUS

(71) Applicant: CANON FINETECH NISCA INC., Misato-shi (JP)

(72) Inventor: Kei Horiuchi, Kofu (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 16/039,680

(22) Filed: Jul. 19, 2018

(65) Prior Publication Data

US 2019/0047806 A1 Feb. 14, 2019

(30) Foreign Application Priority Data

Aug. 9, 2017 (JP) ..... 2017-154673
Jul. 10, 2018 (JP) ..... 2018-130861

(51) Int. Cl.
*B65H 3/48* (2006.01)
*B65H 3/14* (2006.01)
(Continued)

(52) U.S. Cl.
CPC ..... *B65H 3/48* (2013.01); *B65H 1/14* (2013.01); *B65H 3/06* (2013.01); *B65H 3/14* (2013.01);
(Continued)

(58) Field of Classification Search
CPC . B65H 3/14; B65H 3/48; B65H 5/228; B65H 9/108; B65H 29/245; B65H 29/246;
(Continued)

(56) References Cited

U.S. PATENT DOCUMENTS 4,405,125 A * 9/1983 Kulpa ..... B65H 29/246 271/195
6,955,348 B2 * 10/2005 Koga ..... B65H 3/128 271/97
(Continued)

FOREIGN PATENT DOCUMENTS

JP 2005-075541 A 3/2005
JP 2005-096994 A 4/2005
(Continued)

OTHER PUBLICATIONS

Office Action dated Oct. 25, 2019, in Japanese Patent Application No. 2018-130861.

*Primary Examiner* — Jeremy R Severson
(74) *Attorney, Agent, or Firm* — Venable LLP

(57) ABSTRACT

A sheet stacking apparatus includes a stacking unit on which a sheet bundle is to be stacked, a lifting unit that can lift and lower the stacking unit, and an air blower unit that can apply air to a side face of the sheet bundle via an air blowing port. The stacking unit further includes a stacking face that comes into contact with and holds a lowermost sheet of the sheet bundle, and a support portion that supports a portion of the stacking face near an end portion thereof, and has a face that is not parallel to the stacking face. The support portion includes a ventilating portion that allows air blown out by the air blower unit from a portion of the air blowing port to pass through the ventilating portion, the portion of the air blowing port being below the stacking face.

8 Claims, 6 Drawing Sheets

(51) Int. Cl.
*B65H 1/14* (2006.01)
*B65H 3/06* (2006.01)

(52) U.S. Cl.
CPC .... *B65H 2405/111* (2013.01); *B65H 2405/15* (2013.01); *B65H 2406/12* (2013.01); *B65H 2511/152* (2013.01); *B65H 2801/06* (2013.01)

(58) Field of Classification Search
CPC ..... B65H 29/247; B65H 29/248; B65H 2406/12; B65H 2406/121; B65H 2406/1211; B65H 2406/122; B65H 2406/1222; B65H 2406/13; B65H 2406/14
See application file for complete search history.

(56) References Cited

U.S. PATENT DOCUMENTS 7,140,606 B2 11/2006 Suga et al.
7,722,029 B2 * 5/2010 Gruntjes ..... B65H 1/16 271/147
8,074,978 B2 12/2011 Takahashi
8,201,818 B2 * 6/2012 Ueda ..... B65H 1/14 271/97
8,246,033 B2 * 8/2012 Sato ..... B42C 1/12 270/58.07
8,272,732 B2 * 9/2012 Yanagi ..... B41M 5/0017 347/101
8,613,438 B2 12/2013 Suzuki
9,630,794 B2 * 4/2017 Chiwata ..... B41J 29/377
2004/0041328 A1 3/2004 DiNatale et al.
2005/0067757 A1 3/2005 Suga et al.
2007/0080491 A1 4/2007 Suga et al.
2012/0133092 A1 * 5/2012 Fuda ..... B65H 3/128 271/104

FOREIGN PATENT DOCUMENTS

JP 2005-335885 A 12/2005
JP 2009-274837 A 11/2009
JP 2011-057309 A 3/2011
JP 2011-225307 A 11/2011
JP 2012-236709 A 12/2012

* cited by examiner

COMPARATIVE EXAMPLE

METHOD FOR APPLYING AIR TO SHEETS STACKED ON SHEET STACKING APPARATUS

BACKGROUND OF THE INVENTION

Field of the Invention

The present invention relates to a method for applying air to sheets stacked on a sheet stacking apparatus.

Description of the Related Art

There are cases where a sheet feeding apparatus is connected to an image forming apparatus to form images on a large amount of sheets. The sheet feeding apparatus feeds sheets one by one to the image forming apparatus from a sheet bundle that is stacked on a tray. To separate a sheet from a sheet bundle, there is a variety of separation methods, such as the retard separation method and the Duplo method.

However, compared with plain paper, coated paper and OHP sheets that have good surface properties involve large adsorption force and negative pressure that are generated between sheets, and accordingly, there have been cases where sheets are not sufficiently separated with a conventional separation mechanism. Japanese Patent Laid-Open No. 2005-96994 proposes a method of blowing air toward sheets to cancel close contact between the sheets, and thereafter feeding the sheets.

However, in a sheet feeding apparatus described in Japanese Patent Laid-Open No. 2005-96994, separation performance is likely to decrease when the remaining amount of sheets has become small. If the remaining amount of sheets is small, the thickness of a sheet bundle is smaller than the height of an air nozzle. A part of the air collides with a side face of a sheet tray, on which the sheet bundle is stacked, then proceeds upward, and pushes up the bottom face of the sheet bundle. Since gravity and a force that is applied by the air flowing above the sheet bundle and pushes down the sheet bundle are exerted on the sheet bundle, the sheets are further brought into close contact with each other. If the sheets are brought into close contact, it is difficult for air to enter between the sheets, resulting in a decrease in separation performance.

SUMMARY OF THE INVENTION

The present invention provides a sheet stacking apparatus comprising a stacking unit on which a sheet bundle is to be stacked, a lifting unit configured to lift up and down the stacking unit, and an air blower unit configured to apply air to a side face of the sheet bundle via an air blowing port. The stacking unit further includes a stacking face that comes into contact with and holds a lowermost sheet of the sheet bundle, and a support portion that supports a portion of the stacking face near an end portion thereof, and has a face that is not parallel to the stacking face. The support portion includes a ventilating portion that allows air blown out by the air blower unit from a portion of the air blowing port to pass through the ventilating portion, the portion being below the stacking face.

Further features of the present invention will become apparent from the following description of exemplary embodiments (with reference to the attached drawings).

DESCRIPTION OF THE EMBODIMENTS

Sheet Feeding Apparatus

Figure 1:
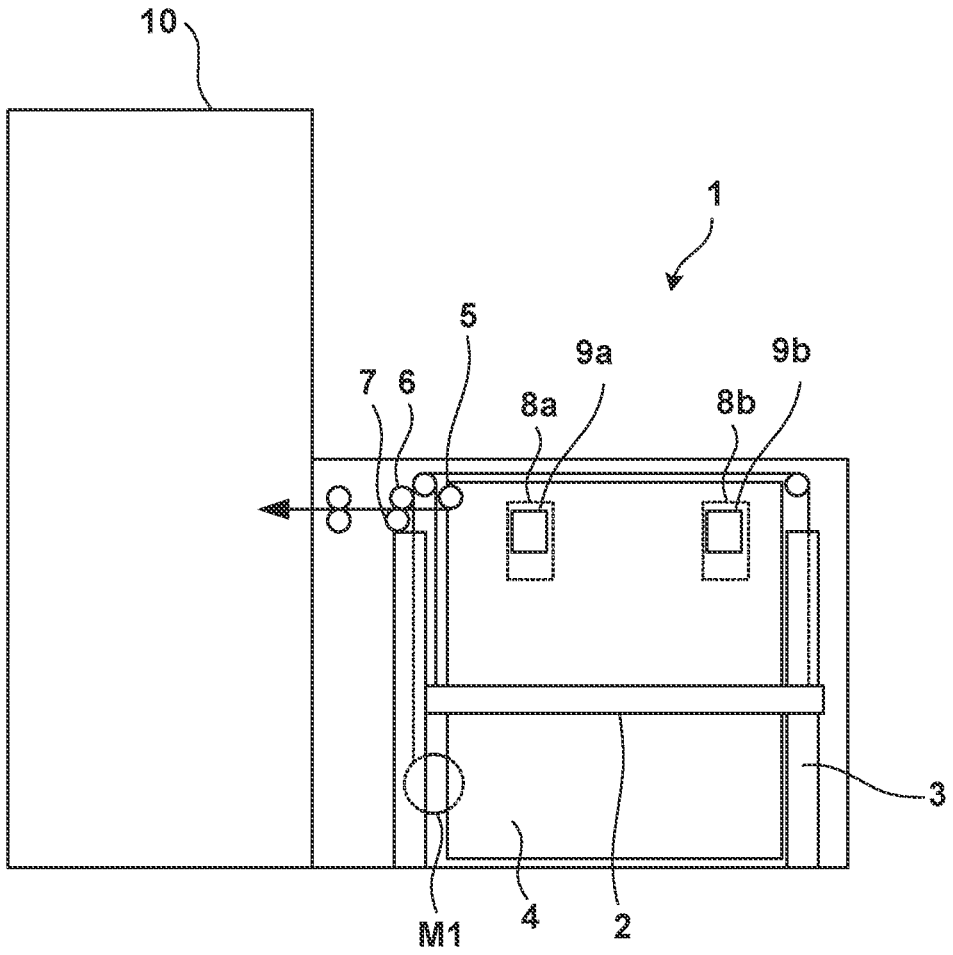
FIG. 1 is a schematic cross-sectional diagram of an image forming system.
Figure 2A:
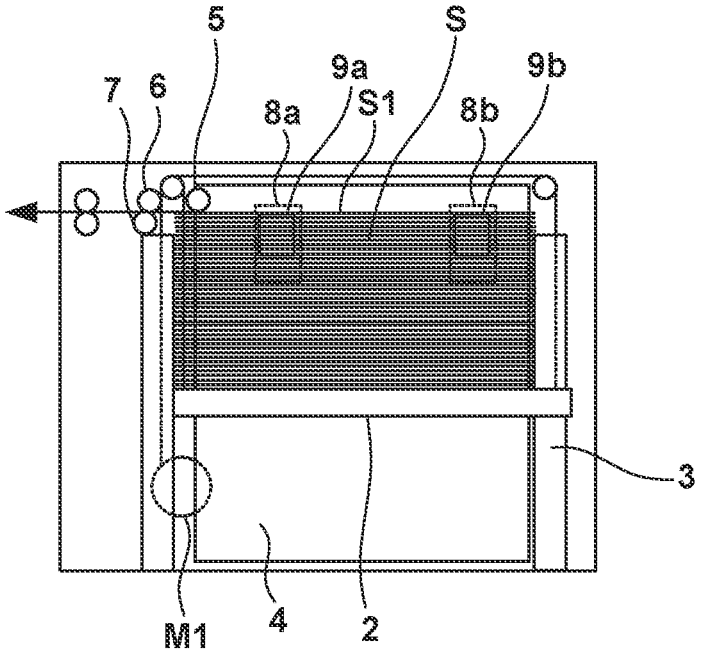
FIGS. 2A and 2B illustrate a sheet feeding apparatus.
Figure 2B:
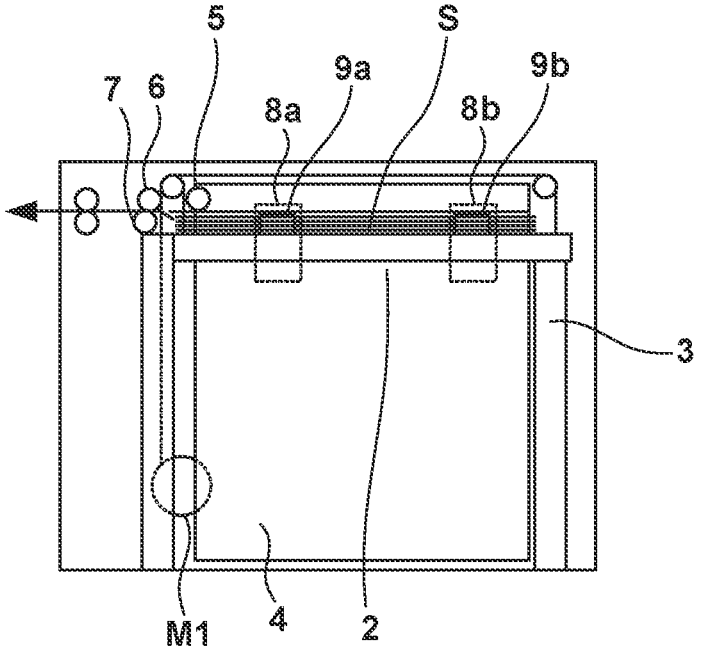

FIGS. 1, 2A, and 2B are schematic cross-sectional diagrams of a feeding apparatus 1. The feeding apparatus 1 is a sheet feeding apparatus for feeding sheets to an image forming apparatus 10. As shown in FIG. 2A, a tray 2 is a stacking unit that can be lifted up and lowered and on which a sheet bundle S is stacked. A motor M1 is joined to the tray 2 via a wire and a plurality of pulleys. The tray 2 is lifted up when the motor M1 rotates forward, and the tray 2 is lowered when the motor M1 rotates backward. As shown in FIG. 2B, the motor M1 lifts up the tray 2 every time the amount of sheets stacked on the tray 2 decreases.

A rear end restricting plate 3 is a restricting unit for restricting the position of the rear end of the sheet bundle S. The rear end refers to an upstream end in the sheet feeding direction. A pair of side end restricting plates 4 are restricting members for restricting the positions of both side ends of the sheets in the width direction, which is perpendicular to the sheet feeding direction. When feeding the sheets S, a pickup roller 5 is lowered, comes into contact with the uppermost sheet S1 of the sheet bundle S, and then rotates to feed the sheet S1. A feed roller 6 is a conveyance member for conveying sheets conveyed by the pickup roller 5, further toward the downstream side. A retard roller 7 rotates so as to return the sheet fed by the pickup roller 5 toward the upstream side, and separates the uppermost sheet S1 from the other fed sheets.

Air blower mechanisms 8*a* and 8*b* for separating sheets by means of air are provided on at least one of the two side end restricting plates 4. The air blower mechanisms 8*a* and 8*b* have a fan and air blowing ports 9*a* and 9*b*. As a result of air blown out from the air blowing ports 9*a* and 9*b* being blown between sheets, a plurality of sheets are loosened up so as to be separated into individual sheets.

Tray

Figure 3A:
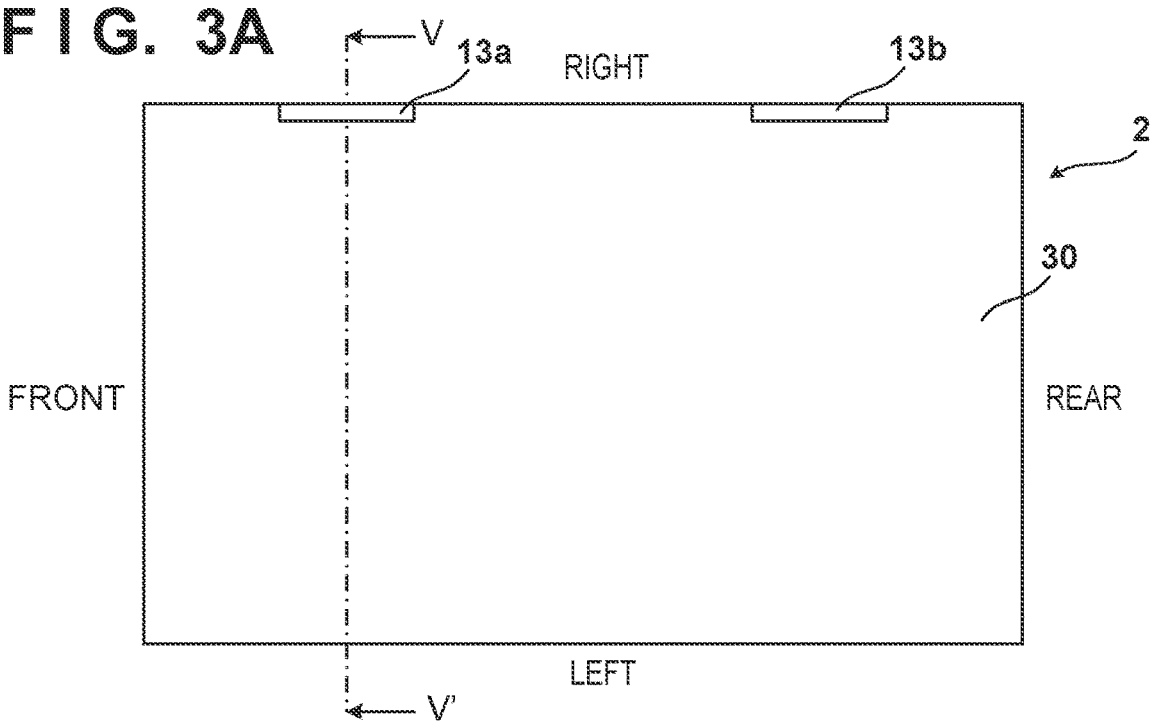
FIGS. 3A to 3F illustrate a tray.

FIG. 3A is a plan view of the tray 2. Two cutouts 13*a* and 13*b* are provided near a right end portion of a stacking face 30 of a stacking plate that constitutes the tray 2. The cutouts 13*a* and 13*b* are provided at positions opposing the air blowing ports 9*a* and 9*b*. The cutouts 13*a* and 13*b* function as ventilating portions for letting a part of the air blown out from the air blowing ports 9*a* and 9*b* escape toward the bottom face of the sheet bundle S when the amount of stacked sheets has become small.

Figure 3B:
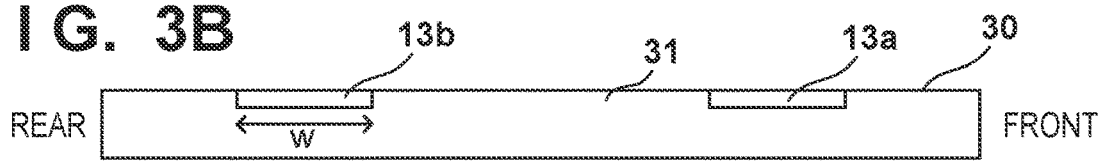

FIG. 3B shows a support member 31 located on a right side face of the tray 2. The support member 31 supports the stacking plate that has the stacking face 30, and restrains deformation of the stacking face 30 due to the load of the sheet bundle S. Note that the two cutouts 13*a* and 13*b* extend from the stacking face 30 to the support member 31. Note that the width W of the two cutouts 13*a* and 13*b* may be equal to the width of the air blowing ports 9*a* and 9*b*, but specifically, the loosening effect will increase if the width W is made wider than the width of the air blowing ports 9*a* and 9*b*. Meanwhile, if the width W is made extremely wide, the bottom face of the lowermost sheet may be rubbed against end portions of the cutouts 13*a* and 13*b*. Accordingly, the width W is determined so that sheets will not be soiled or damaged.

Figure 3C:
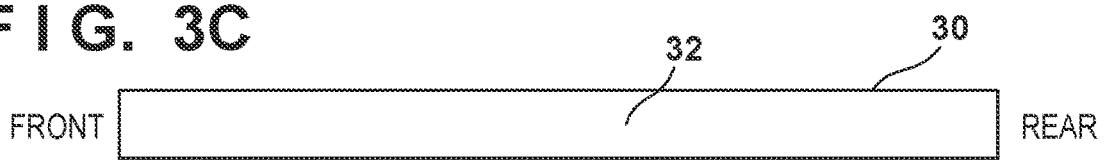

FIG. 3C shows a support member 32 that is located on a left side face of the tray 2. The support member 32 supports the stacking plate that has the stacking face 30, and restrains deformation of the stacking face 30 due to the load of the sheet bundle S.

Figure 3D:
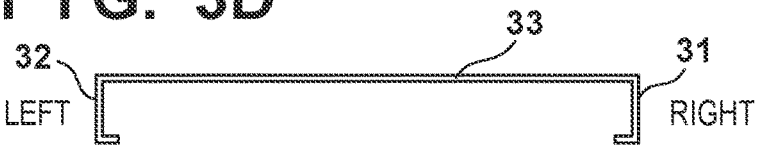
Figure 3E:
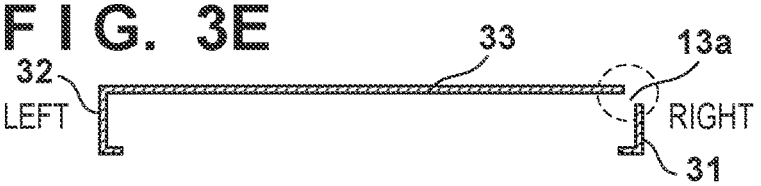

FIG. 3D is a side view showing a rear end of the tray 2. FIG. 3E is a cross-sectional view obtained by cutting off the tray 2 along a cut-off line V-V' shown in FIG. 3A. Specifically, FIG. 3E clearly shows that the cutout 13*a* is provided near a connecting portion at which the stacking plate 33 that has the stacking face 30 is connected to the support member 31.

Figure 3F:
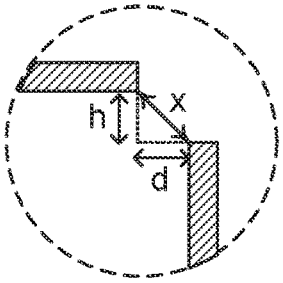

FIG. 3F is an enlarged view of the cutout 13*a*. The height h and depth d of the cutout 13*a* are determined so that the sheet-loosening effect can be readily achieved. The depth d refers to the depth of the cutout 13*a* when viewed from a side end portion of the support member. Each of the height h and the depth d need only be 5 mm or greater, for example. Meanwhile, the height h and the depth d are determined as values that do not allow a finger of an average adult to be inserted into the cutout 13*a*. In this embodiment, each of the height h, the depth d, and the length x of an imaginary inclined plane (imaginary hypotenuse) obtained by compositing the height h and the depth d is less than 14.9 mm (mechanical tolerance is ±5% or less). More preferably, it will be difficult for an index finger to be inserted into the cutout 13*a* if each of the height h, the depth d, and the length x is less than 11.9 mm.

Although the cutout 13*a* has been described here, the cutout 13*b* may also have equal dimensions. The number of cutouts 13 need only be one or more. However, the number of cutouts 13 is the same as the number of air blower mechanisms 8. Characters a and b that follow the reference numerals are used when distinguishing between a plurality of items, but are omitted when not distinguishing therebetween.

Effects of Ventilating Portions

As mentioned above, each air blower mechanism 8 blows out air from the air blowing port 9 before sheets start to be fed, and thus executes sheet separation (loosening of sheets). As shown in FIG. 2A, if the height (thickness in the vertical direction) of the sheet bundle S is greater than the height (length in the vertical direction) of the air blowing port 9, air enters between sheets in a sheet group to which air is applied in the sheet bundle S, and the sheets float up in the air. Thus, the sheet bundle S is loosened up, and the sheets therein are separated.

Figure 4A:
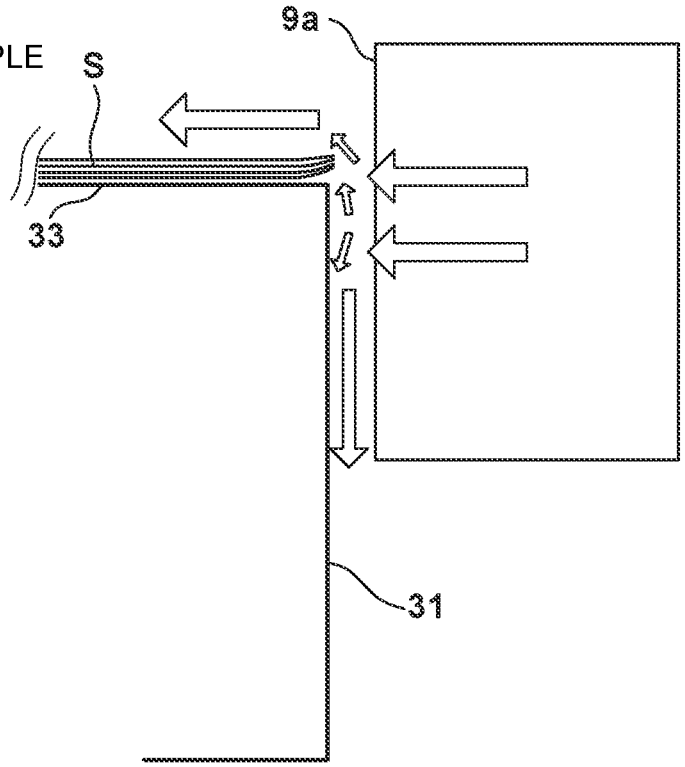
FIGS. 4A and 4B illustrate a flow of air.

As shown in FIG. 2B, there are cases where the height of the sheet bundle S is smaller than the height of the air blowing port 9. FIG. 4A is a schematic cross-sectional diagram of the tray 2 and the air blower mechanism 8 in a comparative example in which no cutout 13 is provided. The arrows indicate the direction and flow of air. When the remaining amount of sheets has become small, the support member 31 provided at an end portion of the tray 2 blocks the lower portion of the air blowing port 9. Air blown out from the lower portion of the air blowing port 9 collides with the support member 31. A part of the air proceeds upward along the support member 31, and the other part of the air proceeds downward along the support member 31. In particular, the air that proceeds upward collides with the bottom face of the lowermost sheet of the sheet bundle S and pushes up the sheet bundle S. As a result, sheets come into close contact with each other, then it is difficult for the air to enter between the sheets, and separation performance deteriorates.

Figure 4B:
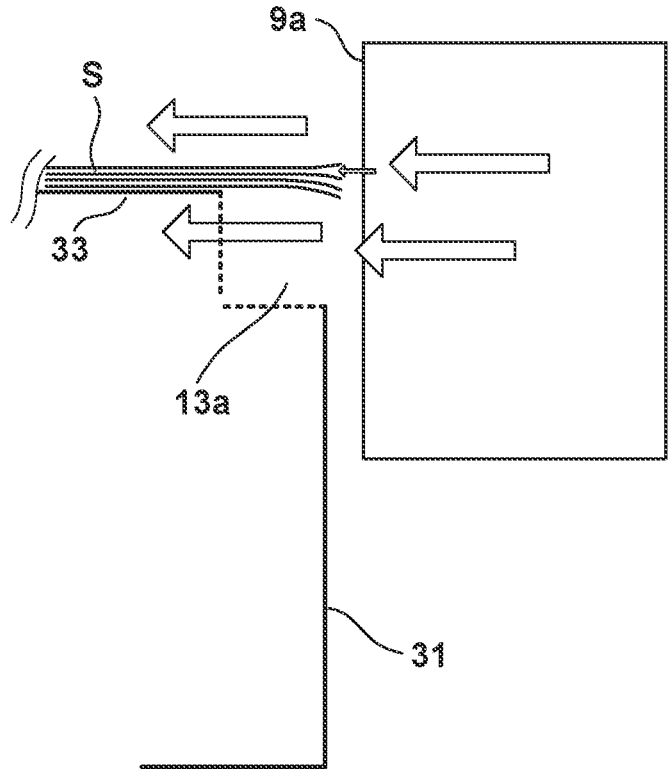

In this embodiment, as shown in FIG. 4B, the cutout 13 provided near the connecting portion at which the stacking face 30 is connected to the support member 31 guides the air blown out from the lower portion of the air blowing port 9, downward of the sheet bundle S. That is to say, air is restricted so as not to proceed upward. Sheets in the sheet bundle S that are on the lower side are pulled downward by the gravity and a force according to the Bernoulli theorem. Sheets in the sheet bundle S that are on the upper side are pulled upward by the force according to the Bernoulli theorem. Thus, gaps between the sheets expand, making it easy for air to enter between the sheets, and separation performance increases. In addition, by thus providing the cutout 13 near the connecting portion at which the stacking face 30 is connected to the support member 31, sheets can be stacked without damaging end faces of the stacked sheets even if a burr or the like has been made during processing.

Summary

The tray 2 is an example of a stacking unit on which the sheet bundle S is stacked. The motor M1 is an example of a lifting unit for lifting up and down the stacking unit. The air blower mechanism 8 is an example of an air blower unit for applying air to a side face of the sheet bundle S to separate a plurality of sheets that constitute the sheet bundle S from each other. The pickup roller 5 is an example of a feeding unit for feeding the uppermost sheet S1 of the sheet bundle S. Note that a conveyance belt that suctions the uppermost sheet S1 to convey this sheet may be employed in place of the pickup roller 5. The tray 2 has the stacking face 30 that comes into contact with and holds the lowermost sheet of the sheet bundle S. The cutout 13 is an example of a ventilating portion for guiding air that is blown out from a portion of the air blowing port 9 of the air blower unit, the portion being below the stacking face 30, so that the air passes below the stacking face 30. Since the ventilating portion thus allows the air blown out from a portion of the air blowing port 9, the portion being below the stacking face 30, to escape so that the air passes below the stacking face 30, sheet separation performance is maintained even when the remaining amount of sheets has become small. Although, in FIG. 2B, air is blown out toward the right side face of the sheets, the air blower mechanism 8 may be provided so that air is blown out toward at least one of the left side face of the sheets, a side face thereof on the leading end side, and a side face thereof at the rear end. In this case as well, the cutout 13 is provided at a position opposing the air blowing port 9.

As shown in FIGS. 3A to 3E, the tray 2 may have the stacking plate 33 that has the stacking face 30, and the support member 31 that supports a portion of the stacking plate 33 near an end portion thereof, and has a face that is not parallel to the stacking face 30 of the stacking plate 33. The cutouts 13*a* and 13*b* shown in FIG. 3A function as ventilating portions for allowing air to escape so that the air blown out from the air blower unit is not deflected by the support member 31 to push up the bottom face of the sheet bundle S. Here, the ventilating portion may be an opening that is only provided in the support member 31, and is not provided in the stacking face 30 of the stacking plate 33. Note that the opening may be a plurality of holes that are opened by machining equipment such as a drill. The loosening effect is particularly maintained when the width W of the cutout 13 is greater than the width of the air blowing port 9 of the air blower unit. However, the dimensions of the cutout preferably are those that do not allow a finger of an average adult to be inserted into the cutout. A comparatively high loosening effect is achieved if the height h of the cutout provided in the support member 31 is 5 mm or greater. Similarly, a comparatively high loosening effect is achieved if the depth d of the cutout 13 provided in the stacking face 30 of the stacking plate 33 is 5 mm or greater. Note that the stacking plate 33 and the support member 31 that form the tray 2 may be a common member that is formed by bending a metal plate. In the case of thus performing a bending process, an effect of readily absorbing an error that occurs during the process can also be achieved by providing the cutout 13 near the connecting portion (continuous portion) at which the stacking face 30 is connected to the support member 31. As shown in FIG. 3D, the stacking face 30 and the face of the support member 31 may be perpendicular to each other. This is effective from the viewpoint of maintaining the stacking face 30 flatly.

Figure 5A:
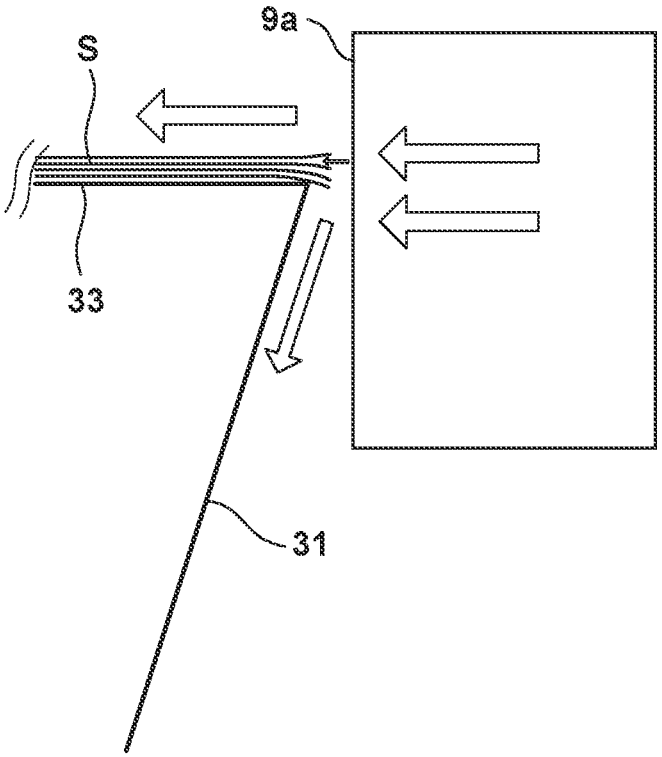
FIGS. 5A and 5B illustrate a modification.
Figure 5B:
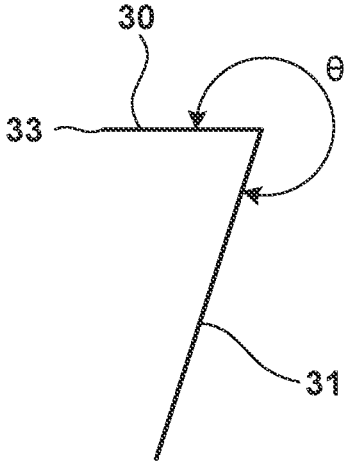

FIGS. 5A and 5B show a modification in which a support member 31 is provided in place of the above-described ventilating portion, the support member 31 serving as a guiding portion for guiding a part of the air blown out from the air blowing ports 9*a* and 9*b* toward the bottom face of the sheet bundle S when the amount of stacked sheets has decreased. The guiding portion is a portion of the support member 31, and this portion, which opposes the air blowing ports 9*a* and 9*b* of the air blower unit, may be formed by the stacking face 30 and a face of the support member 31 that opposes the air blowing ports 9*a* and 9*b* forming an angle θ that is greater than 270 degrees or more, with the stacking face 30 serving as a reference. By thus inclining the support member 31, the support member 31 functions as a guiding portion for guiding the air blown out from a portion of the air blowing port 9, the portion being below the stacking face 30, so that the air passes below the stacking face 30.

Figure 6:
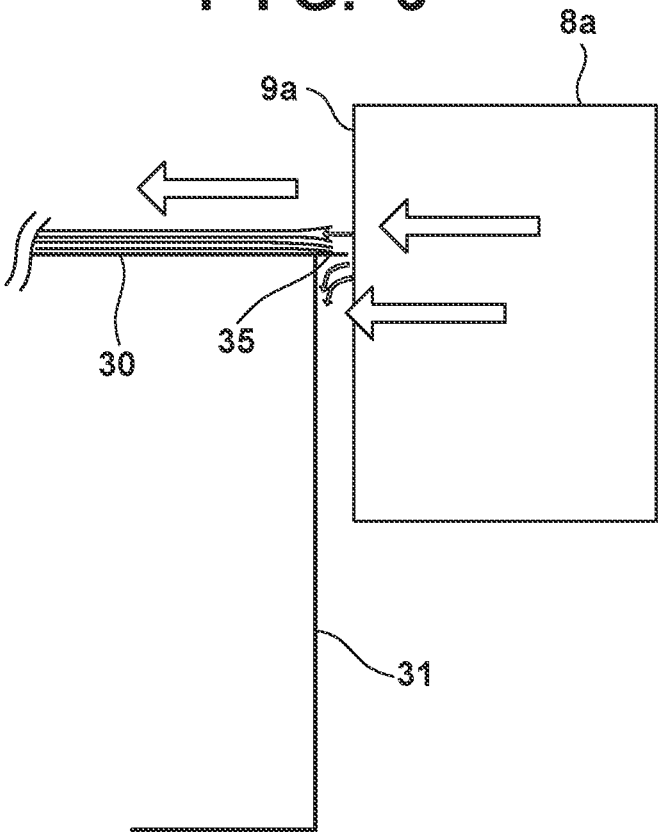
FIG. 6 illustrates a modification.

FIG. 6 shows a modification of the guiding portion. The guiding portion may be an eaves member 35 that protrudes toward the air blower mechanism 8, further than the connecting portion at which the stacking member that has the stacking face 30 is connected to the support member 31. The air blown out from a portion of the air blowing port 9, the portion being below the stacking face 30, collides with the support member 31, and a part of the air is deflected upward. This part of the air collides with the eaves member 35 and is deflected again, and proceeds downward. That is to say, the air blown out from a portion of the air blowing port 9, the portion being below the stacking face 30, is guided by the eaves member 35 so that the air passes below the stacking face 30. Note that the eaves member 35 may be a portion of the stacking plate 33.

Figure 7:
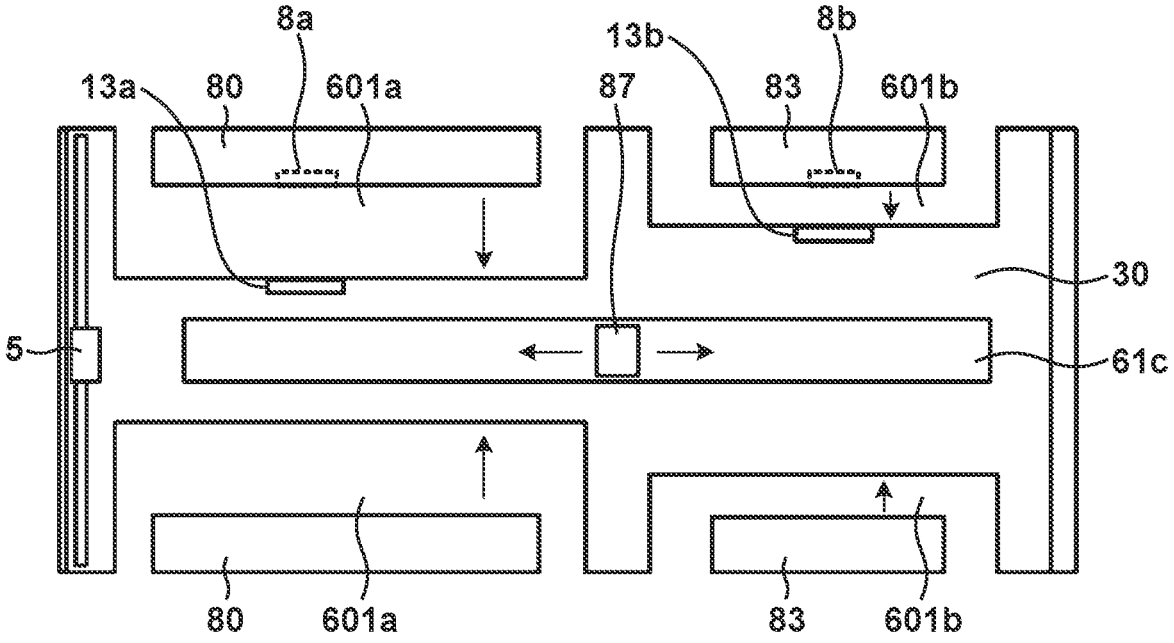
FIG. 7 is a plan view illustrating a modification.

FIG. 7 shows a modification of the stacking plate 33. Opening holes 601*a* and 601*b* are provided in the stacking face 30 of the stacking plate 33. The opening holes 601*a* and 601*b* are formed in the stacking face 30 so that the side restricting members 80 and 83 can move. Also, a rear end restricting member 87 is arranged so as to restrict a rear end portion of sheets stacked on the stacking face 30. The rear end restricting member 87 is supported so as to be able to move in a direction parallel to the sheet feeding direction. This rear end restricting member 87 can move along an elongated positioning hole portion 61*c* that is formed in a center portion of the stacking face 30. The air blower mechanism 8*a* is provided in the side restricting member 80, and the air blower mechanism 8*b* is provided in the side restricting member 83. When the side restricting members 80 and 83 move, the air blower mechanisms 8*a* and 8*b* move together with the side restricting members 80 and 83. In the stacking plate 33 that has the above-described configuration as well, the cutouts 13*a* and 13*b* are provided at positions through which the air blown out from the air blowing ports 9*a* and 9*b* of the air blower mechanisms 8*a* and 8*b* passes, respectively. For example, the cutout 13*a* may be provided so as to oppose the air blowing port 9*a*, and the cutout 13*b* may be provided so as to oppose the air blowing port 9*b*. Thus, the cutouts 13*a* and 13*b* function as ventilating portions that guide the air blown out from portions of the air blowing ports 9*a* and 9*b*, the portions being below the stacking face 30, so that the air passes below the stacking face 30. Also, there is a possibility that the air that passes below the sheets enters the elongated hole portion 61*c*, causing a force that pushes up the sheets. An increase in separation efficiency at a sheet end portion allows air to enter between sheets from a sheet end portion, and separation performance for a bundle of sheets will further improve.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-154673, filed Aug. 9, 2017, and Japanese Patent Application No. 2018-130861, filed Jul. 10, 2018, which are hereby incorporated by reference herein in their entirety.

What is claimed is:

1. A sheet stacking apparatus comprising:

a stacking unit on which a sheet bundle is to be stacked, the stacking unit including:

a stacking face that comes into contact with and holds a lowermost sheet of the sheet bundle; and a support portion that supports a portion of the stacking face near an end portion thereof, and has a support face that is not parallel to the stacking face;

a lifting unit configured to lift and lower the stacking face and the support portion together; and an air blower unit configured to apply air to a side face of the sheet bundle via an air blowing port, wherein an opening is formed on the support face, and in a case in which the stacking face lifted by the lifting unit is located at a predetermined height and the air blown out from the air blowing port flows toward the side face of the sheet bundle and the support face, a part of the air blown out from the air blowing port passes through the opening and then flows to a first side of the stacking face opposite to a second side, on which the sheet bundle is disposed, across the stacking face.

2. The sheet stacking apparatus according to claim 1, wherein the opening is provided at a connecting portion at which the stacking face is connected to the support portion.

3. The sheet stacking apparatus according to claim 2, wherein the opening is a cutout formed by cutting out a section of the connecting portion.

4. The sheet stacking apparatus according to claim 3, wherein each of the height of the cutout in a vertical direction, the depth of the cutout when viewed from a side end portion of the support portion, and the length of an imaginary hypotenuse of the cutout having the height and the depth is less than 14.9 mm.

5. The sheet stacking apparatus according to claim 4, wherein each of the height and the depth is 5 mm or greater.

6. The sheet stacking apparatus according to claim 1, wherein the width of the opening is greater than the width of the air blowing port, in a direction parallel to the stacking face.

7. The sheet stacking apparatus according to claim 1, wherein the stacking face and the support portion comprise a common member formed by bending a metal plate.

8. The sheet stacking apparatus according to claim 1, wherein the stacking face and the support face are perpendicular to each other.

* * * * *